US010086633B1

(12) United States Patent
Yraceburu et al.

(10) Patent No.: US 10,086,633 B1
(45) Date of Patent: Oct. 2, 2018

(54) BIAS ARMS

(71) Applicant: Hewlett-Packard Development Company, L.P., Houston, TX (US)

(72) Inventors: Robert Yraceburu, Camas, WA (US); Timothy Jacob Luedeman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/700,899

(22) Filed: Sep. 11, 2017

(51) Int. Cl.

| | |
|---|---|
| ***B41J 23/00*** | (2006.01) |
| ***B41J 25/308*** | (2006.01) |
| ***B41J 2/015*** | (2006.01) |
| ***B41J 29/02*** | (2006.01) |
| ***B41J 2/145*** | (2006.01) |

(52) U.S. Cl.
CPC ..... *B41J 29/02* (2013.01); *B41J 2/145* (2013.01)

(58) Field of Classification Search
CPC ... B41J 29/02; B41J 2/145; B41J 2/155; B41J 2/16505; B41J 11/005
USPC ..... 347/8, 20, 37
See application file for complete search history.

(56) References Cited

U.S. PATENT DOCUMENTS

| | | | | |
|---|---|---|---|---|
| 5,419,644 | A | 5/1995 | Martin et al. | |
| 5,594,486 | A | 1/1997 | Kiyohara | |
| 6,565,182 | B1 * | 5/2003 | Fredrickson | B41J 2/16547 347/104 |
| 6,869,176 | B2 | 3/2005 | Saito | |
| 6,883,909 | B2 | 4/2005 | Kanazawa et al. | |
| 8,714,734 | B2 | 5/2014 | Sugitani | |
| 9,211,718 | B2 | 5/2015 | Luedeman et al. | |
| 9,844,955 | B2 * | 12/2017 | Sano | B41J 11/005 |
| 2016/0089902 | A1 | 3/2016 | Sano | |

* cited by examiner

*Primary Examiner* — An Do
(74) *Attorney, Agent, or Firm* — Brooks Cameron & Huebsch PLLC

(57) ABSTRACT

In an example, a printing device can include a pivot point, a bias arm formed of a rigid member to rotate about the pivot point, the bias arm comprising a first end to extend into a print zone and a second end opposite the first end, and a spring in communication with the second end of the bias arm to bias the first end to contact the platen.

15 Claims, 4 Drawing Sheets

BIAS ARMS

BACKGROUND

Inkjet printers can deposit quantities of printing fluid onto a printable media (e.g., paper, plastic, etc.). In some examples, inkjet printers can create a curl and/or cockle in the printed media when the printing fluid droplets are deposited by the inkjet printer. In some examples, a number of physical properties of the printable media can be changed when the printing fluid droplets are deposited by the inkjet printer. For example, the stiffness of the printable media can be changed when the printing fluid droplets are deposited by the inkjet printer; therefore, the media may curl, cockle, and/or other physical properties may be changed due to the presence of the printing fluid droplets.

DETAILED DESCRIPTION

Figure 1:
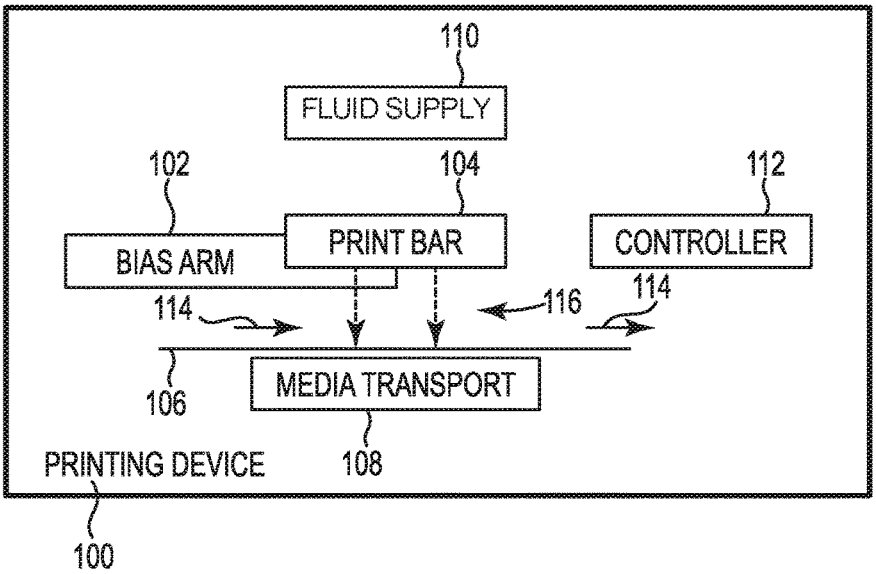
FIG. 1 illustrates a block diagram of an example of a printing device suitable with a bias arm consistent with the present disclosure.

A number of systems and devices employing bias arms are described herein. In some examples, a printing device can include a pivot point, a bias arm formed of a rigid member to rotate about the pivot point, the bias arm including a first end to extend into a space between a platen and a print head; and a second end opposite the first end, and a spring in communication with the second end of the bias arm to bias the first end to contact the platen.

An inkjet printing device can include a print zone to deposit a printing fluid on a print media. Inkjet printing devices such as page wide inkjet printing devices may be susceptible to media jams and/or print quality defects due to media interfering with the orifice plates and other features on the print head and/or movement of media while printing. For instance, a stationary media wide print bar in an inkjet printer may be susceptible to media jams and print quality defects from the print media crashing into the print heads.

The bias arms described herein can be positioned within an inkjet printing device. The bias arms described herein can be utilized to prevent media from contacting a print bar/print head, maintain a desired amount of spacing between the media and print bar, and/or position (i.e., disposition) media against a platen during printing so the media follows a shape of the platen. Thus, the bias arms described herein can be utilized to provide the multiple functions related to printing in a printing device such as an inkjet printing device Moreover, the bias arms can desirably facilitate readily altering an amount of pressure applied by a bias arm to a platen (or media) by simply replacing a given spring with a different spring (having a different spring constant and/or a different force at a given deflection), instead of other approaches such as those that employ a shim member that is deflected (i.e., a leaf spring) which may necessitate altering difficult to change and/or expensive components of a printing device to change an amount of pressure applied.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Examples of a bias arm are described with reference to an inkjet printer using a media wide print bar. However, examples of the bias arm are not limited to media wide print bars or inkjet printers but might also be implemented with other print mechanisms and in other inkjet type dispensers.

FIG. 1 illustrates a block diagram of an example of a printing device suitable with a bias arm 102 consistent with the present disclosure. Referring to FIG. 1, printing device 100 includes a print bar 104 that includes an arrangement of print heads to dispense ink on to a sheet or continuous web of paper or other print media 106. Printing device 100 also includes a print media transport mechanism 108 (rollers, etc.) to move print media 106, a fluid supply 110 to supply a fluid such as ink to the print bar 104, and a printing controller 112. Controller 112 represents the programming, processor(s) and associated memories, and the electronic circuitry and components to control operative elements of printing device 100.

As described in detail below with reference to FIG. 2 and FIG. 3, bias arm 102 can be positioned as an upstream part relative to print bar 104 (with respect to print media path 114) and can extend into a print zone 116 to prevent print media 106 from contacting the print bar 104, maintain a desired spacing between the print media 106 and the print bar 104. Notably, bias arm 102 can also disposition media 106 against a platen, as described herein, with a force that can be varied by changing a spring (e.g., spring 230 as illustrated in FIG. 2) coupled to the bias arm 102, in contrast to other approaches that do not or may not disposition print media against a platen (e.g., platen 240 as illustrated in FIG. 2) and/or may not permit readily altering a force dispositioning print media 106 against the platen.

Figure 2:
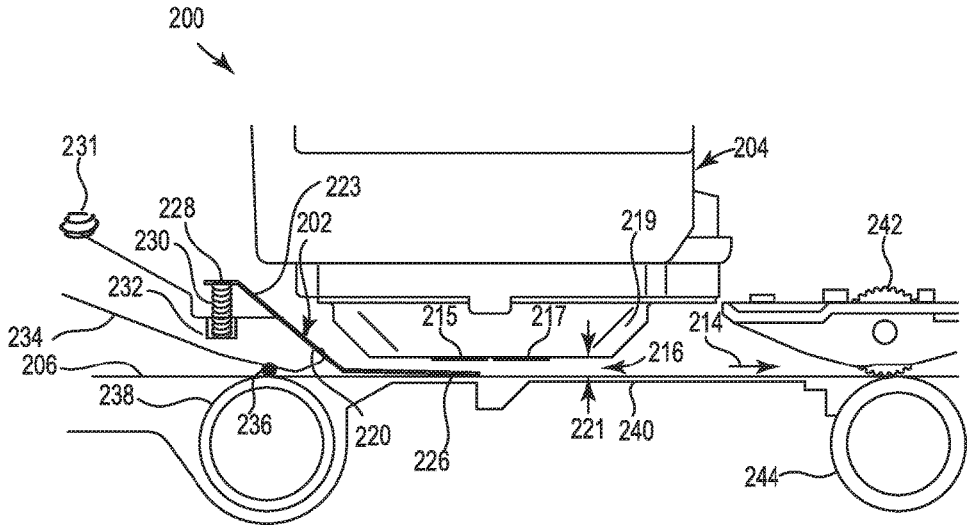
FIG. 2 illustrates an example view of a portion of a printing device employing a bias arm consistent with the present disclosure.

FIG. 2 illustrates an example view of a portion of a printing device 200 employing a bias arm 202 consistent with the present disclosure. As illustrated in FIG. 2, the printing device 200 can include a bias arm 202 positioned upstream from a downstream print head such as print head 215, 217.

As illustrated in FIG. 2, print bar 204 can be positioned over a media support platen 240 to define a print zone 216 in which a fluid such as ink is dispensed on to the paper or other print media 206. Media transport (referenced generally in FIG. 1 as media transport 108) includes print zone entry rollers 236, 238 and exit rollers 242, 244. In some examples, exit roller 242, is illustrated as star wheels 242 that can help minimize damaging an ink image on media 206 as it exits print zone 216.

As illustrated in FIG. 2, the print heads 215, 217 can be surrounded by a protective shroud 219. Print bar 204 represents, for example, a media wide print bar 204 suitable for one pass color printing. In addition to supporting print heads 215, 217 and shroud 219, print bar 204 can provide the structural support and reference surfaces for accurately mounting print bar 204 in a printing device such as printing device 200. Print bar 204 may also house the distribution system for delivering ink to each print head 215, 217 including, for example, via ink channels (not illustrated). Shroud 219 represents any suitable structure to protect print heads 215, 217 and other parts of print bar 204 against collisions with the print media and/or damage from exposure to ink aerosol, debris, and other contaminants that may be generated in print zone 216. Nevertheless, as illustrated in FIG. 2, each print head 215,217 can protrude from print bar 204. Thus, having the bias arm 202 disposition media against the platen 240 can prevent the leading edge of print media (e.g., print media 206) from crashing in to the protruding downstream print head 215, 217 and instead desirably guides the leading edge of the media down, away from all print heads 215, 217.

Pivot point 220 can refer to a portion (e.g., print zone entry roller 236) of an upper entry roller assembly 234 upstream of print zone 216. For instance, as illustrated in FIG. 2, the pivot point 220 can be a fixed point that is integral with the upper entry roller assembly 234 of a printing device. More specifically, pivot point 220 can be located on a print zone entry roller 236. That is, while the pivot point 220 can be a fixed location on the upper entry roller assembly 234, as detailed herein the upper entry roller assembly 234 can move (e.g., up/down). Moreover, as illustrated in FIG. 2, print zone entry roller 236 can be smaller in size, for instance having a diameter that is one third of a diameter of print zone entry roller 238, among other possible ratios, to promote aspects of bias arms such as promoting the bias arm 202 to contact the platen 240 and/or media with a desired/consistent amount of force during operation of the printing device 200.

The bias arm 202 can be coupled to the pivot point in a permanent or semi-permanent manner using various suitable mechanical fasteners to promote aspects of bias arms, as described herein. Thus, the bias arm 202 can form a cantilever that extends out and down from the upper entry roller assembly 234 into print zone 216. In some examples, the bias arm 202 can be a Z shaped, cantilever bias arm 202, as illustrated in FIG. 2.

The bias arm 202 can rotate about the pivot point 220 to contact the platen 240, contact media, and/or biased away from a print bar/print head. For instance, the upper entry roller assembly 234 can be coupled to a second spring 231 to disposition the upper entry roller assembly 234 (in a downward direction coplanar with distance 231 extending from the print bar 204 to the platen 240) into a neutral position. That is, the second spring 231, as illustrated in FIG. 2, is separate and distinct from the spring 230 (i.e., the first spring 230). Desirably, the first end 226 can be tapered, rounded, or otherwise have a small radius to promote consistent contact with the platen 240, as described herein in greater detail with respect to FIG. 3.

However, the upper entry roller assembly 234 may translate up/down dynamically. Due to the dynamic nature of the upper entry roller assembly 234 having the first end 226 dispositioned to contact the platen 240 and/or media, it can desirably maintain the bias arm in contact with the platen 240 and/or media even when the upper entry roller assembly moves up/down. Moreover, bias arm 202 can be formed of a rigid member comprised of metal, plastic, ceramic, or combinations thereof. Thus, in contrast to approaches that may employ a thin or flexible material, the bias arm 202 can desirably maintain a near constant amount of force applied to the platen 240 and/or to media.

In various examples, a body 223, a first end 226, and a second end 228 can together form a continuous rigid member. For example, the first end 226 can extend from and be integral with the body 223 and similarly the second end 228 can extend from and be integral with the body 223. Having the bias arm 202 formed of a continuous rigid member can desirably apply a consistent amount of force to a platen 240 and/or a media 206 present on the platen 240 as compared to other approaches that may employ thin flexible shim members or multiple distinct components which are coupled together by hinges or otherwise mechanisms.

Spring 230 can be in communication with a second end 228 of the bias arm 202, as illustrated in FIG. 2. In this manner, the spring 230 can impart a force on the second end 228 of the bias arm 202 to bias the first end 226 to contact the platen 240. That is, as illustrated in FIG. 2, the first end 226 can be in direct contact (without an intermediary) with the platen, for instance when no media is present between the print bar and the platen 240 and/or when media is not located under a print head 215, 217. In various examples, the spring 230 can be disposed in a recess 232 in upper entry roller assembly 234, as illustrated in FIG. 2. However, in some examples the spring can be coupled to a protrusion extending from the upper entry roller assembly 234, among other possibilities.

The spring 230 and resulting biasing of the first end 226 enables the first end 226 of the bias arm 202 to stay in contract with the platen 240 and/or media even when a distance 221 between the platen 240 and the print bar 204 is varied. Similarly, the spring 230 and resulting biasing of the first end 226 enables the first end 226 of the bias arm 202 to stay in contract with media of varying thicknesses. As a result, the first end can position media against the platen a particular distance (e.g., distance 221 less a thickness of a given media) from the print head. However, as detailed with respect to FIG. 3, it is understood that the bias arm 202 can move a distance away from the platen 240 to permit media to move along a print media path 214 and/or to exert a force on media on the platen 240.

Notably, in various examples, the first end 226 is to rotate about the pivot point 220 to contact the platen 240 with a first force (in a direction substantially orthogonal the print media path 214) that is lower than an amount of force exerted by spring 230 on the second end 228 (in a direction substantially orthogonal to the print media path 214 but in an opposite direction for the first force) due at least in part due to having a comparatively longer moment arm, as illustrated in FIG. 2. As mentioned, an amount of the first force can be tailored for a desired application simply by changing the spring 230 to a different spring having a different spring force and/or a different spring constant to permit readily changing the first force.

Testing shows that placing the bias arm to extend into a space between a platen and a print head (i.e., the print zone 216), as shown, significantly reduces the instances of print media contacting print heads 215, 217 and/or jamming in print zone 216. Also, bias arms can be selectively placed in particular areas, notably very close to the print heads where they can be wiped clean of debris and ink residue during print head servicing operations.

Media jams may occur at print heads 215, 217 for the print bar configuration shown, and thus placing the bias arm 202 immediately upstream from the print heads 215, 217 is desirable, it may be desirable for other print head configurations or in different printing applications to place the bias arm 202 at other locations. That is the placement of bias arm shown in FIGS. 2-3 is just an example of a suitable configuration of a bias arm. As illustrated, the pivot point 220, the bias arm 202, and the spring 230 can each be positioned upstream from a print head such as print head 215, 217 of the print bar 204 along the print media path 214.

Figure 3:
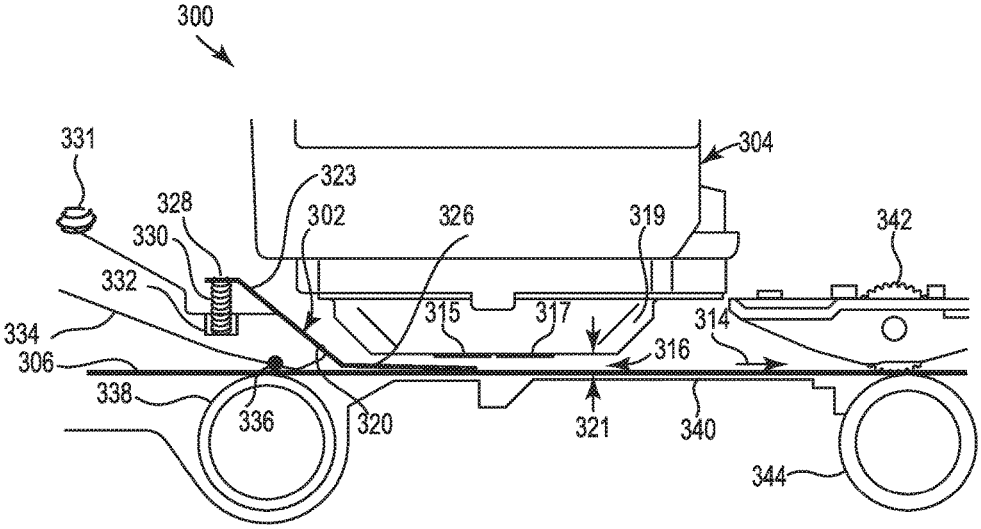
FIG. 3 illustrates another example view of a portion of a printing device employing a bias arm consistent with the present disclosure.

FIG. 3 illustrates another example view of a portion of a printing device 300 employing a bias arm 302 consistent with the present disclosure. As illustrated in FIG. 3 the printing device 300 can include a bias arm 302 having a body 323, a first end 326, and a second end 328, a print bar 304, a print media path 314, a print zone 316 extending between print heads 315, 317 of the print bar 304 and a platen 340, a shroud 319, a spring 330 (i.e., a first spring 330) disposed in a recess 332, a second spring 331, print zone entry rollers 336, 338 and exit rollers 342, 344. Elements can be the same or analogous to corresponding elements in the other Figures. For example, printing device 300 can be the same or analogous to printing device 100, 200, and 400 as described with respect to FIGS. 1, 2, and 4, respectively. Similarly, bias arm 302 can be the same or analogous to bias arm 102, 202, and 402 as described with respect to FIGS. 1, 2, and 4, respectively In various examples, printing device 300 can receive print media 306. As illustrated in FIG. 3, print media can vary in thickness (relative to a thickness of print media 206 illustrated in FIG. 2). Desirable, bias arm 302 can be dispositioned by spring 330 against print media of varying sizes/thickness as illustrated by FIG. 2 and FIG. 3 to printing device 300 and can readily accommodate varying sizes/thicknesses of print media.

That is, as illustrated in FIG. 3, a print head such as each of print heads 315, 317 can be positioned above the platen 340 along the print media path 314 to promote printing on print media 306. In this manner, a print head such as print head 315, and/or print head 317 is to administer a liquid to a media, for instance, while the first end 326 positions the media a particular distance from the print head (e.g., a distance equal to distance 321 less a thickness of print media). That is, in various examples, the bias arm is to hold a media in place when the media is in a print zone 316 (i.e., a space between the platen 340 and a print head such as print heads 315, 317) prior to, during, and/or subsequent to printing of fluid by the print head(s) on media 306. For instance, a distal end of the first arm 326 can hold a media in place when the media 306 is in the print zone 316.

In some examples, the first end 326 can be tapered or rounded to promote consistent contact with the platen 340. For instance, a distal end (furthest from the body 323) of the first end 326 can be tapered or rounded. For example, the distal end of the first end 326 can be tapered in a manner to mirror the contours of the platen at a point of the platen that the distal end is to contract the platen. Such tapering can promote flush contact between the distal end and the platen and/or mitigate a possibility of damage to media contacted by the distal end. In some examples, the distal end of the first end 326 can be coated with a material such as rubber, silicon, polytetrafluoroethylene (PTFE), and/or a polymer to promote consistent contact with media, reduce generation of media dust, and/or mitigate a possibility of damage to the media when contacted by the distal end of the first end 326.

For instance, in some examples, as the first end 326 is dispositioned by media 306 toward the print head(s) 315, 317 in a first direction (coplanar with distance 321), the spring 330 can exert a force on the second end 328 in a second direction substantially the same as (and coplanar with) the first direction. That is, in some examples, the first force and the second force can be exerted on the ends of the arm in substantially the same direction. As used herein, a second force in substantially the same direction as the first force refers to a force having a direction and amount sufficient that is equal to or greater than the first force so as to retain the bias arm 302 in a position to contact the platen 340 and/or the media 306.

Figure 4:
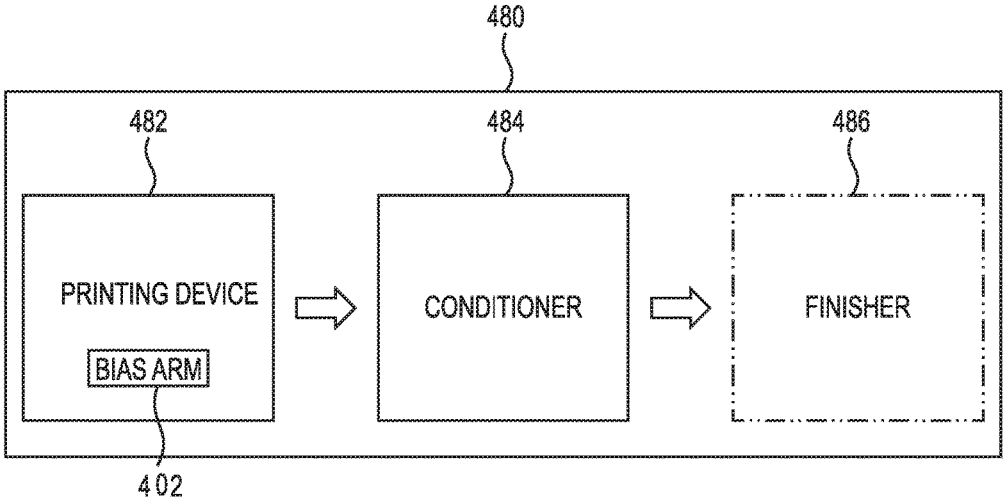
FIG. 4 is a schematic illustration of an example of a system including a bias arm consistent with the disclosure.

FIG. 4 is a schematic illustration of an example of a system 480 including a bias arm consistent with the disclosure. In some examples, the system 480 can include a printing device 482 that can generate print media. The printing device 482 can be any printing that can deposit printing fluid (e.g., ink, etc.) on media (e.g., paper plastic, etc.). As illustrated in FIG. 4, the printing device 482 can include a bias arm 402, as described herein.

The system 480 can be utilized to prepare print media for a finishing process performed by a finisher 486. In some examples, the printing device 482 can prepare print media and send it to a conditioner 484, which can send print media to the finisher 486 to undergo the finishing process. In some examples, print media can be prepared by the printing device 482 including the bias arm 402 for a subsequent finishing process performed by the finisher 486.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A printing device, comprising:
- a pivot point;
- a bias arm formed of a rigid member to rotate about the pivot point, the bias arm comprising:
  - a first end to extend into a print zone; and
  - a second end opposite the first end; and
- a spring in communication with the second end of the bias arm to bias the first end to contact the platen.

2. The printing device of claim 1, wherein, when media is present in the print zone, the spring is further to disposition the media in the print zone against the platen.

3. The printing device of claim 1, wherein pivot point further comprises a fixed point, wherein the fixed pivot point is integral with an upper entry roller assembly of the printing device.

4. The printing device of claim 1, wherein the pivot point, the bias arm, and the spring are positioned upstream from a print head along a print media path.

5. The printing device of claim 4, wherein the print head is positioned above the platen.

6. The printing device of claim 5, wherein:
- the print head comprises a print head; and
- the first end positions media against the platen a particular distance from the print head.

7. The printing device of claim 6, wherein the print head is to administer a liquid to the media while the first end positions the media the particular distance from the print head.

8. A printing device, comprising:
- a platen;
- a print head positioned above the platen;
- a pivot point;
- a spring; and
- a bias arm to rotate about the pivot point, the bias arm including:
  - a body;
  - a first end extending from and integral with the body; and
  - a second end extending from and integral with the body, wherein second end is to in communication with a spring to bias the first end toward the platen and away from the print head.

9. The printing device of claim 8, wherein as the first end is dispositioned by media toward the print head in a first direction, the spring exerts a force on the second end in a second direction substantially the same as the first direction.

10. The printing device of claim 8, wherein a distal end of the first end is to hold a media in place when the media is in a print zone, wherein the distal end of the first end is tapered and mirrors a contour of the platen or wherein the distal end of the first end is curved and does not contact the platen.

11. The printing device of claim 8, wherein the body, the first end, and the second end together form a continuous rigid member.

12. A printing system, comprising:

a print bar comprising a print head;

a platen below the print head;

a first spring coupled to an upper entry roller assembly; and a bias arm including:

a first end positioned between the print head and the platen to contact the platen; and a second end positioned between the print head and the roller assembly, the second end is in communication with the spring coupled to the roller assembly to bias the first end to contact the platen.

13. The printing system of claim 12, wherein first end is to contact the platen with a first force that is lower than an amount of force exerted by the spring on the second end.

14. The printing system of claim 13, wherein the first force and the second force are in substantially opposite directions.

15. The printing system of claim 12, wherein the upper entry roller assembly is coupled to a second spring to disposition the upper entry roller assembly to a neutral position relative to a print media path, wherein the second spring is separate and distinct from the first spring.

* * * * *